United States Patent [19]

Ulseth

[11] 4,319,740

[45] Mar. 16, 1982

[54] SHEET FEEDER

[75] Inventor: John W. Ulseth, Roseville, Minn.

[73] Assignee: Minnesota Mining and Manufacturing Company, St. Paul, Minn.

[21] Appl. No.: 161,741

[22] Filed: Jun. 23, 1980

[51] Int. Cl.[3] ..... B65H 3/30

[52] U.S. Cl. ..... 271/22; 271/118; 271/119; 271/162

[58] Field of Search ..... 271/22, 119, 117, 118, 271/162

[56] References Cited

U.S. PATENT DOCUMENTS 3,265,384 8/1966 Shute ..... 271/118 X
4,061,328 12/1977 Fujimoto ..... 271/118 X

FOREIGN PATENT DOCUMENTS 1500956 4/1966 France ..... 271/119
2033876 5/1980 United Kingdom ..... 271/119

*Primary Examiner*—Richard A. Schacher
*Attorney, Agent, or Firm*—Cruzan Alexander; Donald M. Sell; Randall J. Gort

[57] ABSTRACT

A sheet feeder for feeding a single sheet from a stack of sheets by using a rotating cylindrical feed roller having a truncatel portion spaced away from the stack and a full diameter portion able to contact the stack whenever it is lifted by a lifting arm, which is pivoting in a timed relationship to the feed roller. This device simplifies sheet timing and eliminates the need for a constant biasing of the stack against a feeding member.

3 Claims, 4 Drawing Figures

SHEET FEEDER

TECHNICAL FIELD

This invention relates to a sheet feeder for feeding single sheets, as for example sheets of paper, from a stack into an office machine.

It is fundamental that sheet feeders which are utilized in office machines be capable of accurately advancing and orienting single sheets into a defined processing path. It is desirable that this accuracy be achieved while keeping the structure of the sheet feeder as simplistic as possible to avoid the manufacturing costs and service difficulties inherent in more complex structures.

BACKGROUND ART

U.S. Pat. No. 4,023,792 describes a sheet feeding apparatus including a storage cassette for holding a stack of paper sheets which stack is biased against some restraining or limiting member contacting the uppermost sheet. In the embodiments described, this restraining member is either pivoted out of the way or otherwise removed during the feeding process to permit the biased stack to directly contact a frictional feed roller, or the feed roller is lowered to contact the sheets. In either case the feed roller is rotated, upon contact with the paper, to urge the uppermost sheet within the stack of paper, into the paper processing path. The intermittent rotation of the feed roller while it contacts the sheets requires some form of clutch mechanism or mechanical timing arrangement to precisely control the rotation of the feed roller in order to achieve accurate timing and placement during the sheet feeding operation. In addition the constant pressure exerted on the paper stack as it is biased between the restraining member and the biasing means tends to deform the sheets and cause them to stick together so as to complicate the sheet feeding operation.

DISCLOSURE OF THE INVENTION

The present invention affords a simplified apparatus for feeding a single sheet from a stack of sheets in which the stack is biased only during the actual feeding cycle and in which a precise control on the amount of rotation of a feed roller is not required.

The apparatus is of the type utilizing a removable storage cassette containing a stack of sheets stored therein. The storage cassette is adapted to include sheet separating means fixed thereon for separating the uppermost sheet from the stack, and an aperture in the bottom portion of the cassette for allowing access to the stack inside the cassette. A single sheet e.g. of paper is dispensed from this cassette by the sheet feeder of the present invention which comprises frame means, a generally cylindrical friction-type feed roller, lifting means for lifting the stack of paper toward the sheet separating means, and drive means for continuously rotating the feed roller and activating the lifting means at a predetermined time. The cylindrical feed roller is mounted for rotation within the frame means and is truncated to define a flat portion extending longitudinally thereon. The roller is disposed such that during its rotation the roller's cylindrical portion extends below a plane established by the sheet separating means, and the roller's truncated flat portion is spaced above the plane established by the sheet separating means.

The lifting means are disposed in the frame means to enter the aperture in the cassette and lift the paper within the cassette toward the feed roller and the sheet separating means. The lifting means are activated by drive means which are connected to the feed roller such that this lifting action takes place only during that period of rotation of the friction roller in which the roller's flat portion is spaced above the sheet separating means. The lifting means are maintained in this lifted state during the period of the roller's rotation when the remaining cylindrical portion of the roller extends below the sheet separating means and becomes exposed to the paper there beneath. Upon contact with the paper, the feed roller is able to frictionally feed the uppermost sheet of paper from the paper stack. Continued rotation of the drive means permits the lifting means to drop back down to a position where the paper is separated from the sheet separating means. After the lifting means have dropped, continued rotation of the feed roller will not contact the paper and will have no affect on the paper within the cassette.

The present invention provides a sheet feeder which does not require a clutch mechanism or other complicated device to precisely control the rotation of the feed roller, but rather which utilizes the relationship between the truncated portion of the feed roller and the remaining or cylindrical portion of the feed roller in cooperation with the lifting of the paper by lifting means. This arrangement makes it unnecessary to apply continuous pressure or biasing force on the paper to hold it against a restraining member. This results in an improved feeding operation as well as allowing the cassette to be easily removed for the replenishing of paper without the multiple manipulations as are required for example for relieving the tension prior to the removal of the paper cassette in those devices utilizing a constant tensioning device.

DESCRIPTION OF THE ACCOMPANYING DRAWING

The present invention will be further described hereinafter with reference to the accompanying drawing wherein.

DETAILED DESCRIPTION

Figure 1:
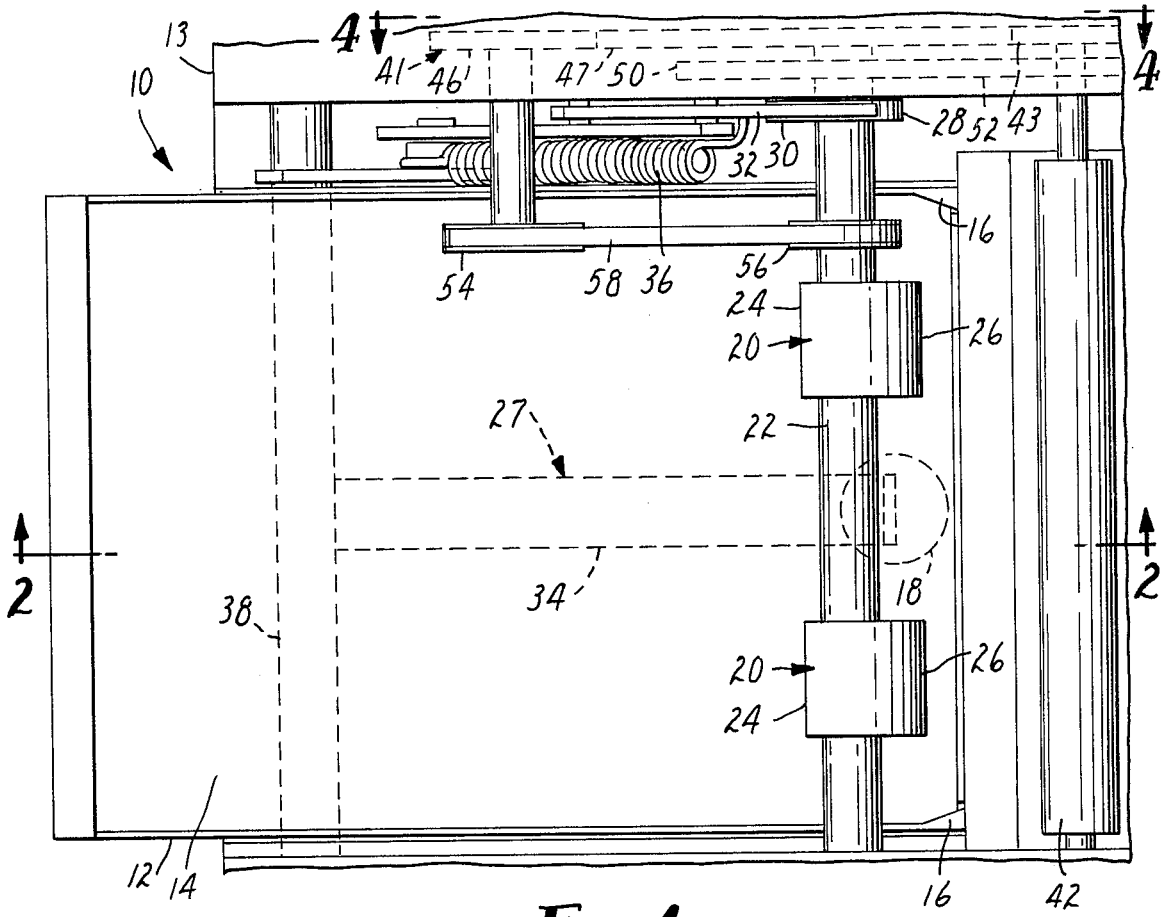
FIG. 1 is a top view of the device according to the present invention.
Figure 2:
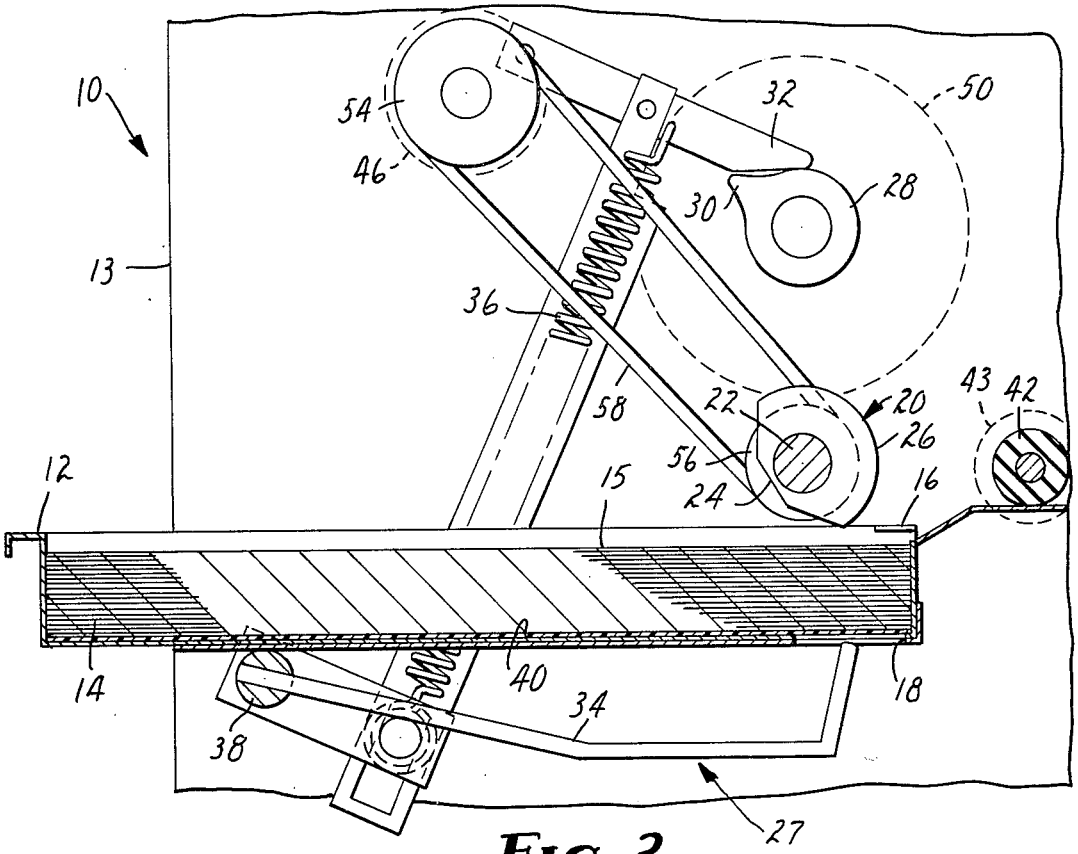
FIG. 2 is a longitudinal section taken along line 2—2 of FIG. 1, illustrating the apparatus prior to feeding a sheet of paper.
Figure 3:
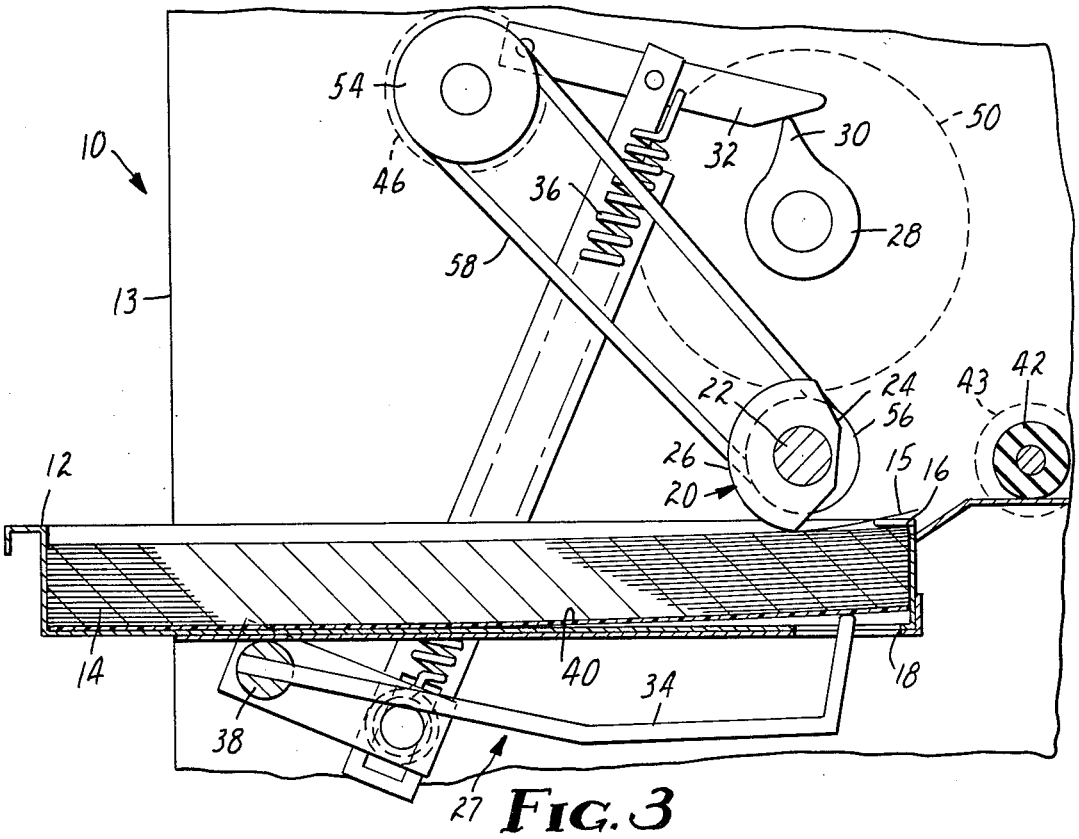
FIG. 3 is a sectional view as in FIG. 2, but showing the apparatus during a feeding cycle.

As illustrated in FIGS. 1 and 2, the sheet feeding apparatus 10 of the present invention utilizes a removable paper storage cassette 12 for storing stacked sheets of paper 14. This cassette 12 is adapted for use with the sheet feeder 10 and includes sheet separating means 16 fixed on the forward and upper end of the cassette 12, and an aperture 18 in the bottom of the cassette 12 which allows access to the bottom of the paper stack 14.

The sheet feeding apparatus 10 comprises frame means 13, a feed roller 20, lifting means 27, and drive means 41. As illustrated in FIG. 1, two or more separate rollers can be used rather than one wide feed roller. This roller 20 is mounted for rotation on a shaft 22 within frame means 13, to urge the uppermost sheet of paper 15 toward the sheet separating means 16, which then separate the uppermost sheet 15 from the remaining sheets in the stack 14. The feed roller 20 is coated with a rubber composition or similar material to enhance its frictional contact with the paper's surface. The roller 20 is generally cylindrical as indicated at 26 but has a truncated or flat portion 24 extending longitudinally thereon. The roller 20 is disposed within the apparatus such that during its rotation the cylindrical portion 26 extends beneath a plane defined by the sheet separating means 16, while the truncated portion 24 remains spaced above the sheet separating means 16 and the paper cassette 12.

The lifting means 27 comprises a cam 28 having a radially extended cam portion 30 thereon. A cam follower 32 is privotally mounted within the frame means 13 to follow the profile of the cam roller. The cam follower 32 is linked to a lifting arm 34 by a spring 36. This lifting arm 34 is mounted to the frame means 13 at pin 38 such that it is able to pivot in response to the lifting of the cam follower 32, between a distal position spaced from the sheet separating means 16 and a proximate position adjacent the sheet separating means 16. This lifting will cause the lifting arm 34 to penetrate the aperture 18 within the cassette 12. A support plate 40 is loosely disposed within the cassette 12 between the bottommost sheet of paper and the inside bottom surface of the cassette 12. This support plate 40 is a rigid plate having a similar size as the paper, which inserted within the cassette 12 prior to the insertion of the stack of paper 14. As the lifting arm penetrates the aperture 18, it contacts the support plate 40 and in so doing lifts the support plate 40, and those sheets of paper 14 stacked above the plate 40, toward the friction roller 20 and the sheet separating means 16.

Figure 4:
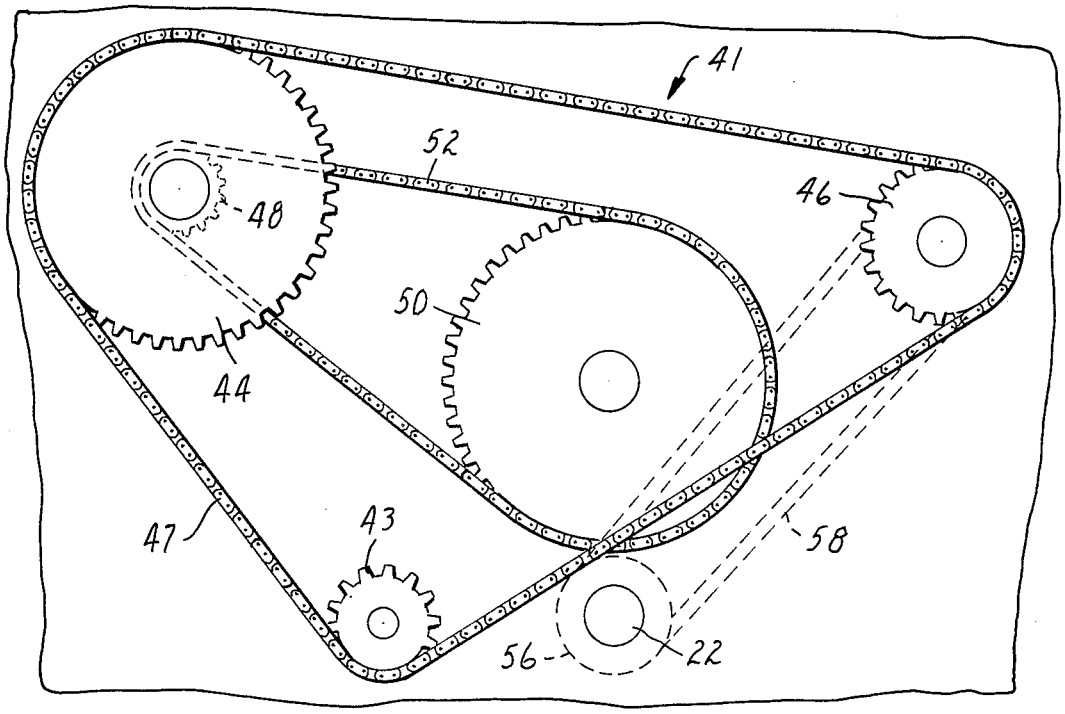
FIG. 4 is a sectional view taken along line 4—4 of FIG. 1, illustrating the drive mechanism utilized by the sheet feeder of the present invention.

The feed roller 20 is connected mechanically to the cam 28 of the lifting means 27 by drive means 41, illustrated in FIG. 4. The drive means 41 include a drive connection from the machine (not shown) which is connected to a drive gear 43. This drive gear 43 is directly connected to an urging roll 42, and is connected via a timing belt 47 to two idler gears 44 and 46. Coaxial with the first idler gear 44 is a secondary gear 48 which in turn drives a cam gear 50 via a timing belt 52. Co-axial with the second idler gear 46 is a secondary gear 54 which drives a feed roller gear 56 via a timing belt 58. The cam roller gear 50 and the feed roller gear 56 are respectively connected to the cam 28 and the feed roller 20. In this manner for every one rotation of the cam 28 the feed roller 20 completes eight revolutions and the urging roll 42 completes 14.4 revolutions.

The extended portion 30 of the cam 28 is initially positioned such that the upward lifting motion is completed just as the leading edge of the cylindrical portion 26 of the roller 20 becomes exposed to the paper stack 14. Since the cylindrical portion 26 extends beneath the plane established by the sheet separating means 16, it comes into frictional contact with the uppermost sheet of the lifted paper 15, and is able to feed this sheet 15 into the urging roll 42. As the urging roll 42 grasps the sheet of paper 15, the feed roll 20 has rotated such that the leading edge of its truncated portion 24 is now exposed to the sheet of paper 15. Since the truncated portion 24 is spaced away from the cassette 12, the feed roll 20 loses contact with the sheet of paper 15 and the urging roll 42 is free to control and further advance the sheet 15.

During this sequence the cam 28 has been continuing its rotation such that its extended portion 30 has now travelled past the cam follower 32. As this happens the cam follower 32 and the lifting arm 34 drop back to their original positions, and the stack of paper 14 is lowered beneath the sheet separating means 16, thus removing the stack of sheets 14 from any possible contact with the feed roller 20. The drive means connecting the cam 28 and the feed roller 20 afford the lifting motion of the lifting means to occur only during that portion of the rotation of the feed roller 20 when the truncated portion 24 is exposed to the paper stack 14. Thus a paper feeding cycle will occur only when the cylindrical portion 26 is exposed to the paper stack 14 and when the paper stack 14 is lifted by the lifting means.

It can be seen that as sheets of paper 15 are fed, the remaining stack of paper 14 within the cassette becomes smaller, and the lifting arm 34 must necessarily travel closer to the sheet separating means 26 in order to bring the uppermost sheet of paper 15 into contact with the feed roller 20. For this purpose the cam follower 32 and the lifting arm 34 are connected with a biasing spring 36. When the cam 28 engages the cam follower 32 a force is transmitted through the spring 36, the lifting arm 34, and the paper stack 14 against the feed roller 20. This force must be adequate to lift the stack of paper 14 to the sheet separating means and to afford adequate pressure against the feed roller 20 to feed the uppermost sheet 15 regardless of the quantity of sheets present in the cassette 12. The spring 36 must be chosen to have a spring constant which can provide this force against the added weight of a full stack of paper, but which under the weight of a diminished stack will afford a closer positioning of the lifting arm 34 to the friction roller 20. The spring 36 must also compensate for any excess forces which occur over the range of paper quantity within the cassette 12. The preferred embodiment uses a helical tension spring 36 which applies approximately 2 pounds of tensioning force for every inch of travel by the distal end of the lift arm 34. This spring 36 has proved satisfactory with a variety of paper bonds throughout the resulting paper depletion cycle as the feeder 10 operates.

Having thus described the preferred embodiment of the present invention it will be understood that changes may be made in size, shape, or configuration of some of the parts without departing from the present invention as described in the appended claims.

What is claimed:

1. A sheet feeding apparatus of the type utilizing a storage cassette for containing sheets, said cassette including sheet separating means for separating the uppermost sheet and a bottom side having an aperture through which the sheets are accessible, said apparatus comprising frame means, a generally cylindrical feed roller, mounted for rotation within said frame means, having a flat portion extending longitudinally thereon and being disposed such that upon rotation said flat portion is spaced above said sheet separating means, and the cylindrical portion of said feed roller extends beneath said sheet separating means, lifting means disposed for lifting the sheets in said cassette until said sheets contact said sheet separating means, drive means for continuously rotating said feed roller and for periodically lifting said lifting means toward said sheet separating means only during a period of the rotation of said feed roller in which said flat portion is spaced above said sheet separating means, and for maintaining the sheets in this lifted state during a period of the rotation of said feed roller in which said cylindrical portion extends beneath said sheet separating means so as to afford frictional contact between said feed roller and the sheets being lifted, thereby feeding the uppermost sheet.

2. An apparatus as claimed in claim 1 wherein said lifting means comprises a cam roller rotatably mounted on said frame means and driven by said drive means, a cam follower pivotally mounted on said frame means, positioned to engage said cam roller and pivot in response to the rotation of said cam roller, a lifting arm mounted in said frame means for pivotal movement between a distal position spaced from said sheet separating means and a proximate position adjacent said sheet separating means, biasing means linking said lifting arm to said cam follower, and a support plate loosely disposed within the cassette between the bottom-most sheet of said stack of sheets and the bottom of said cassette, whereby the rotation of said cam roller affords the pivotal movement of said lifting arm from its distal position to its proximate position so as to lift said support plate and the sheets disposed above said support plate toward said sheet separating means.

3. An apparatus as claimed in claim 2 wherein said biasing means comprises a spring.

* * * * *